United States Patent [19]

Jacobson, Jr. et al.

[11] 4,279,056

[45] Jul. 21, 1981

[54] PAVEMENT JOINT AND CRACK CLEANING MACHINE

[75] Inventors: Carl C. Jacobson, Jr., Tempe; Gaius P. Crosby, Mesa, both of Ariz.

[73] Assignee: Crafco, Inc., Phoenix, Ariz.

[21] Appl. No.: 99,085

[22] Filed: Nov. 30, 1979

[51] Int. Cl.[3] ..... A47L 5/14

[52] U.S. Cl. ..... 15/373; 15/79 A; 15/405

[58] Field of Search ..... 15/79 R, 79 A, 42, 372, 15/373, 405, 355, 356, 358, 362, 366, 368, 383

[56] References Cited

U.S. PATENT DOCUMENTS

| | | | |
|---|---|---|---|
| 1,243,516 | 10/1947 | Harris | 15/405 X |
| 2,489,399 | 11/1949 | Claytor | 15/372 X |
| 2,532,994 | 12/1950 | Chausse | 15/405 X |
| 2,543,833 | 3/1951 | Clark | 15/405 X |
| 3,755,841 | 9/1973 | Goethe et al. | 15/405 X |
| 3,871,051 | 3/1975 | Collier | 15/321 |

*Primary Examiner*—Chris K. Moore
*Attorney, Agent, or Firm*—Herbert E. Haynes, Jr.

[57] ABSTRACT

A machine for cleaning residual and foreign materials from random cracks and expansion joints in pavement subsequent to the opening of such cracks and joints and preparatory to placement of filler-sealer materials therein. The machine includes an open wheeled carriage which carries a platform between its side rails and an engine is mounted on the platform to drive a rotary brush and to drive a blower mechanism. The engine platform is pivotably connected to the carriage for raising and lowering the rotary brush, and the outlet from the blower mechanism is fixed to the wheeled carriage immediately behind the rotary brush.

11 Claims, 5 Drawing Figures

PAVEMENT JOINT AND CRACK CLEANING MACHINE

BACKGROUND OF THE INVENTION

1. Field of the Invention

This invention relates to cleaning mechanisms and more particularly to a machine for cleaning residual materials from random cracks and joints in pavement which have been opened preparatory to placement of filler-sealer materials therein.

2. Description of the Prior Art

Large expanses of asphalt or concrete paved surfaces such as roadways, airport runways, and the like, often develop random cracks during curing and after periods of extended use. Such cracks should be sealed to prevent further spreading and the general deterioration of the paved surface and to insure safe usage of the surface. In addition to sealing random cracks, proper maintenance of paved surfaces is ideally accomplished by periodically replacing the old filler-sealing materials in the expansion joints of paved surfaces.

To prepare the random cracks in a paved surface for sealing, the cracks are opened by a pavement cutting machine which by cutting and abrading actions will remove some of the pavement to widen the cracks so that the filler-sealer material can be inserted therein. this same type of pavement cutting machine is used to remove the old filler-sealant materials from the expansion joints and does so by cutting and chipping the old filler-sealant material while simultaneously removing a thin layer of the pavement from the sidewalls and bottom of the joint to expose clean surfaces to which the new filler-sealer materials will adhere.

Machines suitable for such pavement cutting operations are disclosed in U.S. Pat. No. 4,171,849 issued on Nov. 1, 1979 and U.S. Pat. No. 4,175,788 issued on Nov. 27, 1979.

It will be appreciated that the cutting and abrading operations involved in opening the cracks and joints results in considerable quantities of residual materials such as pavement chips and dust, filler-sealer fragments and the like. Such residual materials and any foreign materials should be removed from the opened cracks and joints in order that proper adhesion of the subsequently inserted filler-sealant material can be effected. Further, the residual and foreign materials immediately adjacent the opened cracks and joints should be removed to prevent such materials from contaminating the filler-sealer during insertion thereof.

In the past, such cleanup was accomplished in most instances by simply blowing air from a backpack blower into the cracks and joints and onto the immediately adjacent areas. This is an excellent way to remove dust and loose relatively small contaminants, however, it does not do a very good job on the larger contaminants and will not remove anything which is stuck in the cracks and joints. A particular problem with stuck materials results from the opening operation itself in that the heat produced by the cutting and abrading will melt some of the filler-sealer materials that are being removed, and some of this melted material will flow back into the cracks and joints and stick to the sides and bottom thereof.

Another prior art cleanup practice is to employ a power driven rotary brush which will loosen and throw most contaminants out of the open cracks and joints. The rotary brush however, is not very effective for removing dust, and does little or nothing as far as cleaning the adjacent areas, and much of the contaminants removed by the rotary brush will fall back into the crack or joint due to the rotational movement of the brush being coincident with the path of the open crack or joint.

Therefore, proper cleanup of an opened pavement crack or expansion joint should involve both a rotary brush operation and an air blowing operation. However, since the rotary brush and blowing operations have been separate in the past, rarely, if ever, have both been employed due to the double labor involved, and the need to use and transport two separate pieces of equipment.

Therefore, a need exists for a new and useful pavement joint and crack cleaning machine which overcomes some of the problems and shortcomings of the prior art.

SUMMARY OF THE INVENTION

In accordance with the present invention, a new and useful machine is disclosed for completely cleaning opened pavement expansion joints and random cracks in a single operation that is accomplished prior to insertion of filler-sealer materials therein.

The machine includes a wheeled carriage of open frame construction with the wheels arranged so that the carriage can be maneuvered for following random cracks, turning around and the like. In a specific embodiment, the carriage has a pair of front wheels on the opposite side rails and a swivel wheel on its rear cross frame member, and a suitable handle is provided for moving and manipulation of the machine. A platform is pivotably carried on the rear cross frame member of the carriage so as to be positioned between the side rails of the carriage and a linear actuator is connected between the front cross frame member of the carriage and the forward end of the platform for adjustably maintaining the pivotable position of the platform. A suitable engine is supported on the platform and its output shaft is coupled by an appropriate drive means to operate a rotary brush. The rotary brush is suitably journaled on the forward end of the platform so that it is pivotably movable with the platform, and this allows it to be raised and lowered relative to the pavement's surface and the crack or joint being cleaned. The rotary brush is positioned adjacent the front wheels of the carriage so that its rotational axis will lie on or near the rotational axis of the front wheels of the carriage which allows precision maneuvering and ease of handling so that an operator can rapidly and accurately follow the most intricate path of a random crack.

The engine output shaft is also employed to drive the blower wheel of an air delivery device the outlet of which is coupled by means of a flexible duct to a nozzle that is fixedly carried on the carriage so that its discharge opening is located immediately behind the rotary brush and has an angularly downwardly directed attitude so that it will blow air under pressure into the joint or crack and onto the immediately adjacent lateral areas thereof.

Accordingly, it is an object of the present invention to provide a new and useful machine for completely cleaning a random crack or expansion joint in paved surfaces.

Another object of the present invention is to provide a new and useful machine for completely cleaning random cracks and expansion joints in pavement which have been previously opened preparatory to the insertion of a filler-sealer material therein.

Another object of the present invention is to provide a new and useful machine of the above described character which simultaneously employs a rotary brush and an air blower device for cleaning the cracks and joints and the laterally adjacent areas thereof.

Another object of the present invention is to provide a new and useful machine of the above described type which has the components thereof arranged in a particular configuration to provide the machine with the characteristics of precision maneuverability and ease of handling.

Another object of the present invention is to provide a new and useful machine of the above described character which includes a manually manipulateable wheeled carriage with a platform supported between its side rails, an engine mounted on the platform for driving a rotary brush and an air blower device. The engine platform is pivotably movable to raise and lower the rotary brush relative to the paved surface, and the outlet of the air blower device is fixedly carried immediately behind the rotary brush.

The foregoing and other objects of the present invention as well as the invention itself, may be more fully understood from the following description when read in conjunction with the accompanying drawings.

DESCRIPTION OF THE PREFERRED EMBODIMENT

Figure 1:
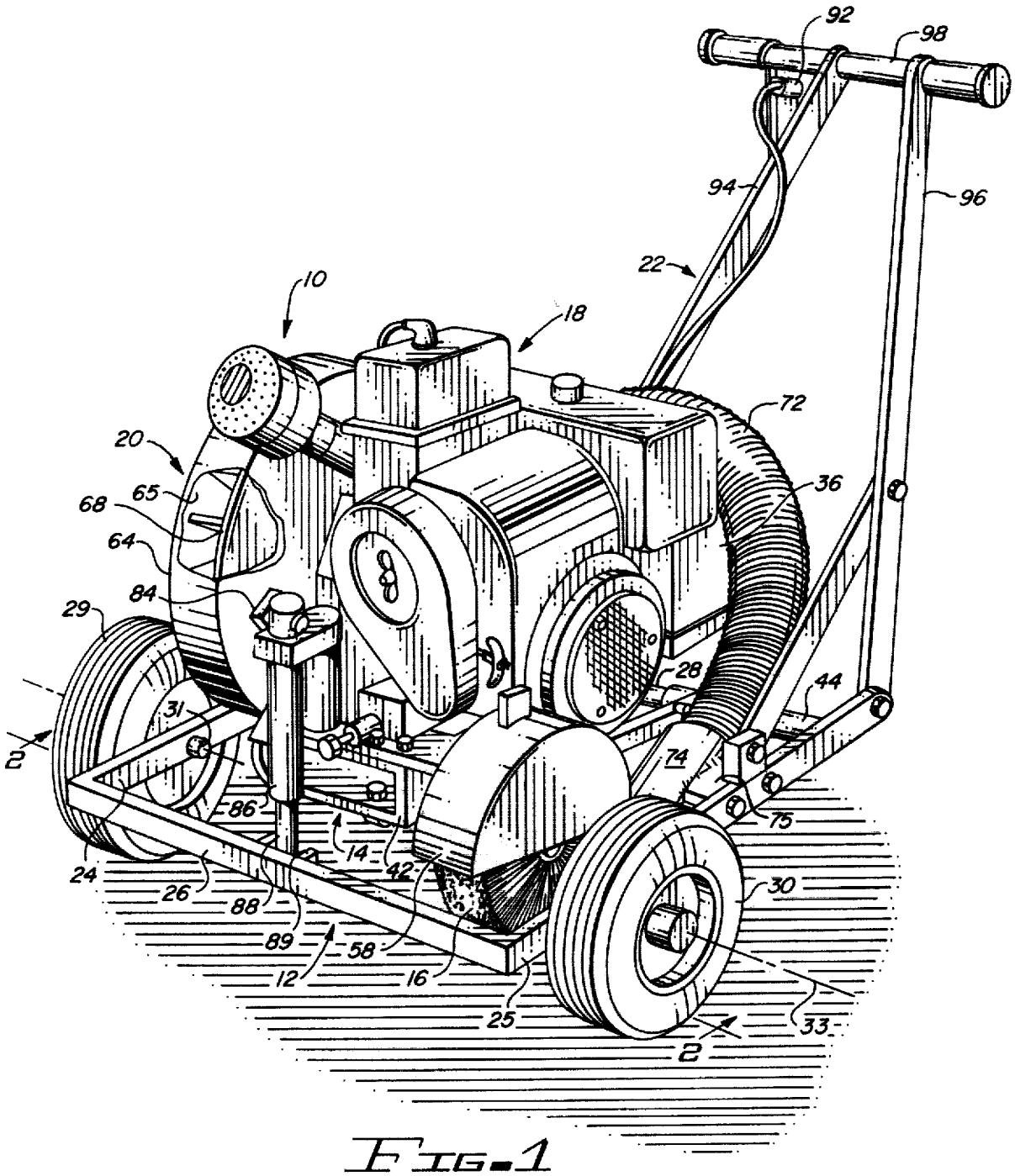
FIG. 1 is a perspective view of the pavement joint and crack cleaning machine of the present invention showing the various features thereof.

Referring more particularly to the drawings, FIG. 1 shows the pavement joint and crack cleaning machine of the present invention which is indicated in its entirety by the reference numeral 10.

As will hereinafter be described in detail, the machine 10 includes the basic components of a wheeled carriage 12, a platform 14 pivotably carried in the carriage, a rotary brush 16 pivotably journaled on the platform, an engine 18 mounted on the platform, an air blower device 20 carried on the engine and a handle 22 by which an operator can manipulate and control the machine.

The carriage 12 is of substantially square open configuration having a spaced pair of side rails 24 and 25 which are connected at their forwardly aligned front ends with a front cross rail 26, and are connected adjacent their rearwardly aligned ends by a rear crossbar 28 which is round in cross section for reasons which will become apparent as this description progresses. The carriage 12 is provided with wheel means in the preferred form of an opposed pair of wheels 29 and 30 which are suitably journaled so as to be freely rotatable on stub axles 31 and 32 which extend oppositely from different ones of the side rails 24 and 25, with those stub axles being located proximate the forward end of the carriage 12. Thus, the wheels 29 and 30 can be considered as front wheels and will rotate about a common wheel axis 33 which is defined by the aligned stub axles 31 and 32.

Figure 3:
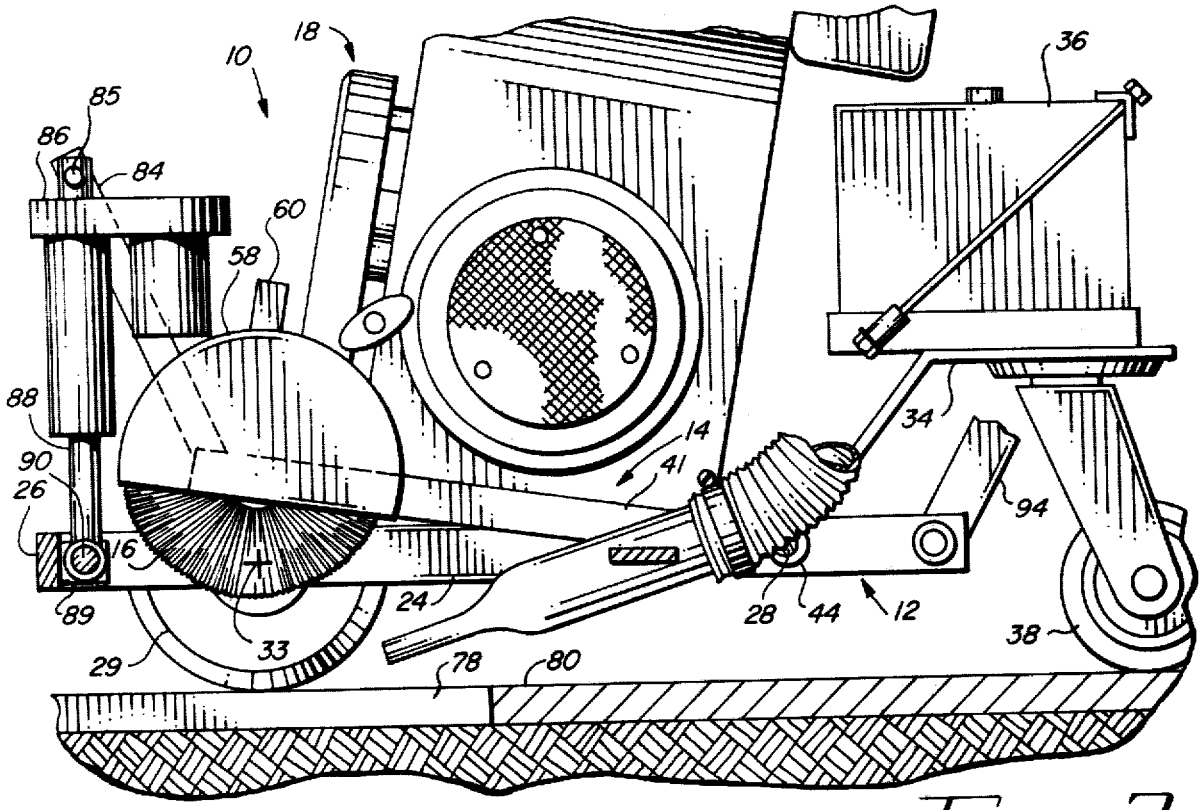
FIG. 3 is a fragmentary sectional view taken on the line 3—3 of FIG. 2.
Figure 4:
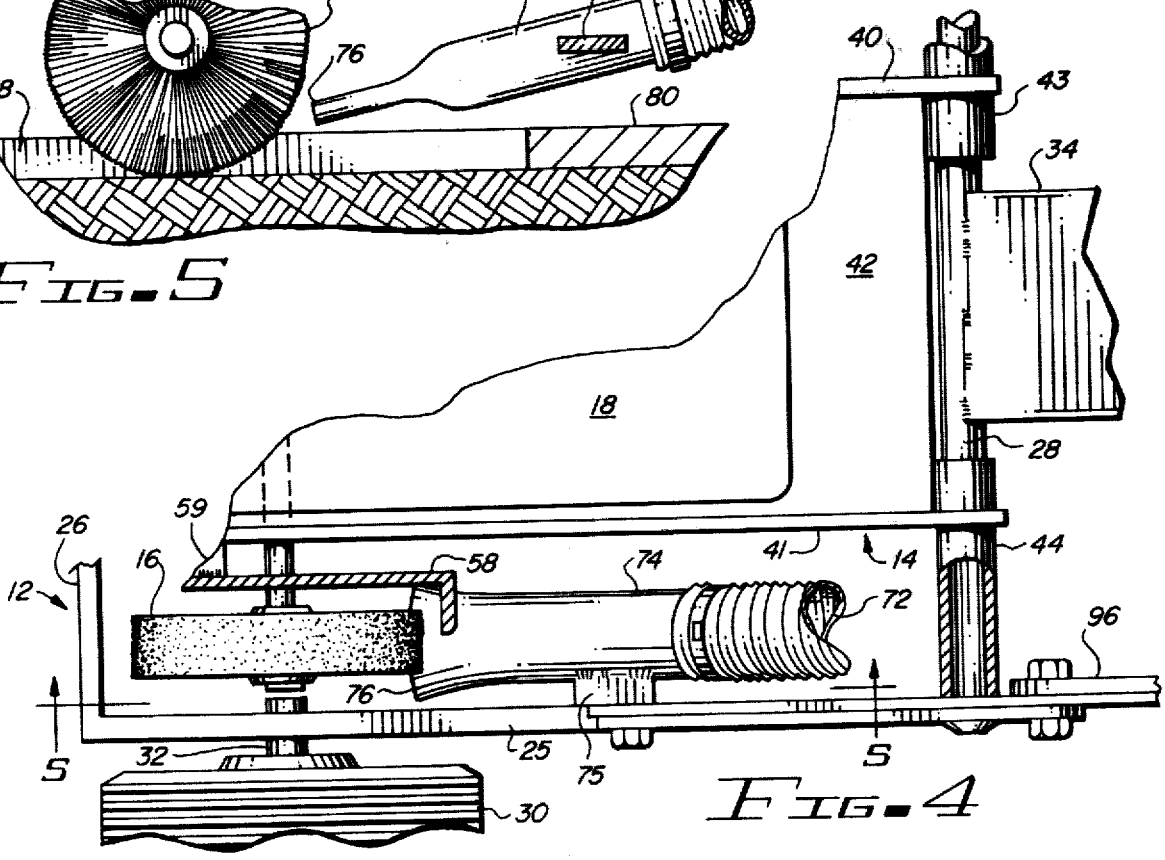
FIG. 4 is a fragmentary sectional view taken on the line 4—4 of FIG. 2.

As seen best in FIGS. 3 and 4, the rear crossbar 28 of the carriage 12 fixedly supports an elevated rearwardly extending plate 34 which is connected centrally thereof, with the plate serving to carry a suitable battery 36 for supplying power to the machine 10. A swivel wheel 38 is mounted so as to depend from the bottom surface of the plate 34. The wheel arrangement of the machine 10 allows the operator to effect precision maneuvering of the machine in that relatively large steering movements of the swivel wheel 38 at the rear of the machine will produce relatively small movements at the front end thereof. Therefore, the rotary brush 16 can be made to follow the most intricate paths of random cracks.

The rear crossbar 28 of the carriage 12 also carries the engine platform 14 intermediate the side rails 24 and 25 thereof. The platform 14 includes a spaced apart pair of side rails 40 and 41 having a plate means 42 extending therebetween. The rearwardly disposed ends of the side rails 40 and 41 have tubular sleeves 43 and 44 transversely affixed, respectively, thereto, with those sleeves 43 and 44 coaxially mounted on the rear crossbar 28 of the carriage 12. In this manner, the engine platform 14 is pivotably movable about the longitudinal axis of the rear crossbar 28.

Figure 2:
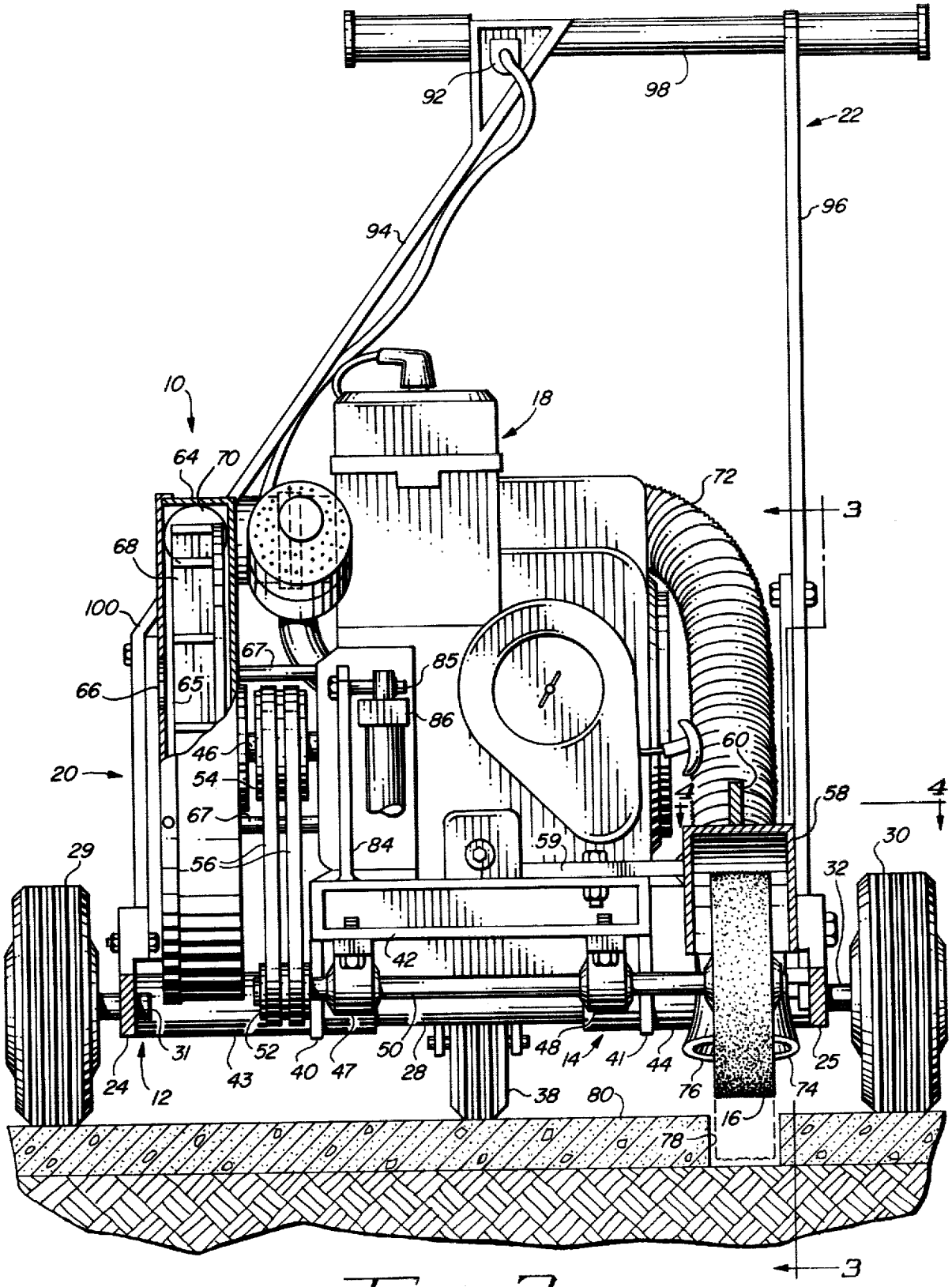
FIG. 2 is an enlarged sectional view taken on the line 2—2 of FIG. 1.

The engine 18 is a standard article of commerce and it will be understood that any suitable engine can be utilized. The engine is mounted atop the platform 14 for movement therewith, and has the usual output shaft 46 as seen in FIG. 2.

A spaced pair of pillow blocks 47 and 48 are spacedly mounted on the forward end of the pivot platform 14 so as to depend therefrom, and an arbor 50 is rotatably journaled therein. The rotary brush 16, which is preferably a wire brush, is fixed on one end of the arbor 50 so as to extend laterally from the platform 14 and thereby be disposed proximate the front wheel 30 of the carriage 12. The other end of the arbor 50 extends laterally beyond the opposite side of the platform 14 and has a pulley 52 mounted fast thereon. The pulley 52 is in alignment with a pulley 54 that is carried on the output shaft 46 of the engine 18, and suitable drive belts 56 pass over the pulleys and drivingly interconnect them.

The arbor 50 defines a horizontally disposed rotational axis about which the rotary brush 16 is rotatably drivable, and that rotational axis will lie on or near the carriage wheel axis 33 as determined by the pivotal position of the platform 14. This particular relationship of the two rotational axes provide the machine 10 with desirable handling characteristics and the capability of being accurately maneuvered to follow random paths.

A brush guard 58 is positioned over the upper portion of the rotary brush 16 by means of a bracket 59 mounted on the plate 42 of the platform 14. A guide pointer 60 is affixed so as to be upstanding from the guard 58 with the pointer facilitating machine guiding movements as will hereinafter be explained.

As seen in FIG. 2, the air blower device 20 includes a housing 64 of generally circular configuration which defines a plenum chamber 65 therein and has an axial air inlet formed in the side thereof. The housing 64 is suitably carried on the side of the engine 18 such as by the spacer bars 67. A blower wheel 68 is suitably mounted for rotation in the plenum chamber 65 of the housing 64, and the engine output shaft 46 is connected directly to the blower wheel for rotational driving thereof. An air discharge port structure 70 is mounted on the housing 64 so as to be in tangential communication with the plenum chamber 65. The port structure 70 is curved (not shown) approximately 90° so that its outlet end is directed across the back of the machine 10 and one end of a flexible duct 72 is connected to the discharge port structure. The opposite end of the flexible duct 72 is connected to a nozzle 74 which is fixedly carried by a bracket 75 on the inwardly facing surface of the carriage side rail 25. The nozzle 74 is of circular cross section and has an air outlet end 76 which is flattened into a subtantially oval configuration which, as seen best in FIG. 2, spreads the outlet air over an area which spans the crack or joint 78 in the paved surface 80 that is being cleaned and over the lateral areas immediately adjacent thereto. Further, with the outlet end 76 being flattened, the nozzle 74 has, in effect, a venturi formed therein which concentrates the air and increases the discharge velocity thereof. The nozzle 74 is mounted in an angularly and downwardly directed attitude so that its outlet end 76 is spaced in close proximity to the paved surface 80 and is disposed immediately behind the rotary brush 16.

An upwardly angularly and forwardly extending bracket 84 is suitably affixed such as by welding, to the front end of the pivot platform 14 and a pin 85 is transversely mounted on the uppermost end of the bracket. A linear actuator means 86, which in the preferred embodiment is an electro-mechanical device, is pivotably suspended from the pin 85. The output shaft 88 of the actuator means 86 has its lower end pivotably secured to a clevis 89 by means of a pin 90, and the clevis is affixed to the inwardly facing surface of the front cross rail 26 of the wheeled carriage 12.

When the linear actuator means 86 is moved to its extended position, which is accomplished by a suitable control device 92 provided for operator use on the handle 22, the platform 14 and all the equipment mounted thereon will be pivotably moved upwardly between the side rails 24 and 25 of the wheeled carriage 12. When such movement is accomplished, the rotary brush 16 will be in its stowed, or nonworking position, which as shown in FIG. 3, is with the brush spaced above the paved surface 80.

Figure 5:
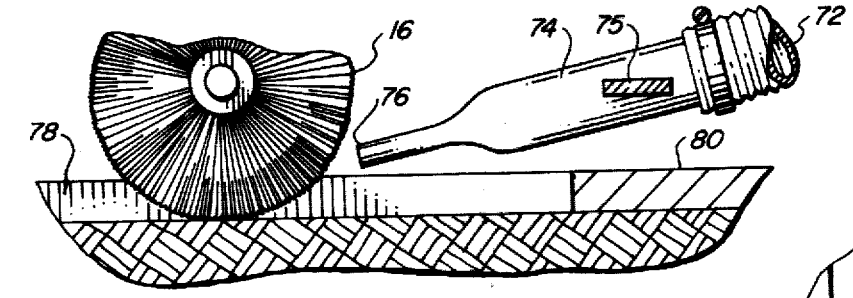
FIG. 5 is a fragmentary sectional view taken on the line 5—5 of FIG. 4.

When the linear actuator means 86 is moved toward its retracted state, the platform 14 and all of the equipment mounted thereon will pivotably move downwardly between the side rails 24 and 25 of the carriage 12. This movement will lower the rotary brush 16 into its working position within the joint or crack 78 of the paved surface 80 as shown in FIG. 5.

The handle 22 is provided with a spaced pair of support bars 94 and 96 with a transverse handle grip bar 98 interconnecting their uppermost ends. The lower ends of the bars 94 and 96 are suitably connected to the rearwardly disposed ends of the side rails 24 and 25 of the carriage 12. As shown best in FIG. 2, the handle 22 is laterally offset toward the rotary brush side of the machine 10 by virtue of the support bar 96 being of substantially straight configuration and the support bar 94 being bent inwardly as at 100. Such a laterally offset disposition of the handle will locate the operator of the machine so that he is in substantial alignment with the rotational plane of the rotary brush 16. Therefore, the operator will be able to easily see the guide pin 60 located on the brush guard 58, and by aligning the pin 60 with the forwardly extending portion of the path of the crack or joint being cleaned, he will be able to easily follow that path.

In view of the above description, a clear understanding of the machine 10 is believed to be apparent. However, to insure complete understanding of the machine's operation, a brief description thereof will be given.

The machine 10 is positioned so as to place the rotary brush above the joint or crack to be cleaned and the engine is started. The linear actuator means is then operated to lower the rotary brush into the crack or joint, and then the machine is pushed by the operator along the path of the joint or crack. Rotation of the rotary brush will dislodge residual and foreign materials from the crack or joint being cleaned and will propel them forwardly of the machine. Air under pressure from the nozzle immediately follows the brushing action and will completely clean the residual and foreign materials from the joint or crack, and from the areas laterally adjacent thereto.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A machine for cleaning expansion joints or random cracks in a paved surface comprising:

(a) a carriage of open configuration having a spaced pair of side rails, a front cross rail and a rear crossbar;

(b) wheel means on said carriage for movement thereof on the paved surface and by which said carriage is steeringly manipulated;

(c) a platform pivotably connected on one of its ends to said carriage so as to extend centrally between the side rails thereof, said platform pivotably movable toward and away from the paved surface;

(d) a rotary brush including means for rotatably journaling said rotary brush on the other end of said platform for movement therewith into and out of the joint or crack to be cleaned;

(e) an engine mounted on said platform;

(f) an air blower device connected to said engine and having an air outlet port;

(g) said engine having an output shaft which is coupled to drive said air blower device;

(h) means connected between the output shaft of said engine and said rotary brush for rotational driving thereof; and (i) a nozzle including means for coupling thereof to the outlet port of said air blower device, said nozzle mounted on said carriage so that its outlet end is adjacent the rear of said rotary brush and positioned proximate the paved surface.

2. A machine as claimed in claim 1 wherein said wheel means comprises:

(a) a pair of wheels each rotatably journaled on a different one of the side rails of said carriage, said pair of wheels being in alignment with each other and defining a wheel axis, said pair of wheels located adjacent the front cross rail of said carriage; and (b) a swivel wheel mounted so as to extend rearwardly from the center of the rear crossbar of said carriage.

3. A machine as claimed in claim 1 and further comprising:

(a) said wheel means including a pair of wheels rotatably journaled on different ones of the side rails of said carriage and in alignment with each other to define a wheel axis; and (b) said rotary brush mounted on said platform so that its axis of rotation is movable in an arc which passes through the wheel axis of said wheel means when said platform is pivotably moved.

4. A machine as claimed in claim 1 and further comprising a linear actuator connected between said carriage and said platform for pivotably moving said platform and maintaining the pivoted position thereof.

5. A machine as claimed in claim 1 wherein said means for rotatably journaling said rotary brush comprises:

(a) an arbor rotatably mounted on the bottom surface of said platform and disposed so that its longitudinal axis is transverse with respect to the side rails of said carriage; and (b) said rotary brush fixedly mounted on one end of said arbor for rotation therewith and to position said rotary brush proximate one of the side rails of said carriage.

6. A machine as claimed in claim 5 and further comprising:

(a) a brush guard mounted on said platform and configured to protectingly cover a portion of said rotary brush; and (b) a guide pointer mounted on said brush guard for aiding an operator in aligning said rotary brush with the path of the joint or crack to be cleaned and following that path.

7. A machine as claimed in claim 5 and further comprising handle means connected to said carriage for movement and manipulation thereof, said handle means extending rearwardly of said carriage and laterally offset so as to be substantially aligned with said rotary brush.

8. A machine as claimed in claim 1 wherein said air blower device comprises:

(a) a housing of substantially circular configuration attached to said engine, said housing defining a plenum chamber and having an axial air inlet formed therein;

(b) a blower wheel rotatable in the plenum chamber of said housing; and (c) the air outlet port of said air blower device is a structure connected to said housing and positioned substantially tangential with respect thereto.

9. A machine as claimed in claim 1 wherein said means for coupling said nozzle to the outlet port of said air blower device includes a flexible duct.

10. A machine as claimed in claim 1 wherein said nozzle is mounted on one of the side rails of said carriage and is oriented so that its outlet is directed angularly downwardly toward the paved surface.

11. A machine as claimed in claim 1 wherein said nozzle has its outlet end of elongated oval configuration which is sized to span the joints or cracks to be cleaned and the areas laterally adjacent thereto.

* * * * *